US009807512B2

(12) United States Patent
Wang et al.

(10) Patent No.: US 9,807,512 B2
(45) Date of Patent: Oct. 31, 2017

(54) SPEAKER

(71) Applicants: Hongxing Wang, Shenzhen (CN); Lubin Mao, Shenzhen (CN); Shun Guo, Shenzhen (CN)

(72) Inventors: Hongxing Wang, Shenzhen (CN); Lubin Mao, Shenzhen (CN); Shun Guo, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/075,609

(22) Filed: Mar. 21, 2016

(65) Prior Publication Data

US 2017/0034632 A1 Feb. 2, 2017

(30) Foreign Application Priority Data

Jul. 31, 2015 (CN) ..... 2015 2 0571691 U

(51) Int. Cl.

| | |
|---|---|
| ***H04R 9/04*** | (2006.01) |
| ***H04R 9/06*** | (2006.01) |
| *H04R 9/02* | (2006.01) |
| *H04R 31/00* | (2006.01) |

(52) U.S. Cl.

CPC ..... *H04R 9/045* (2013.01); *H04R 9/06* (2013.01); *H04R 9/025* (2013.01); *H04R 9/047* (2013.01); *H04R 31/006* (2013.01); *H04R 2499/11* (2013.01)

(58) Field of Classification Search

CPC ... H04R 2440/00–2440/07; H04R 1/08; H04R 9/08; H04R 11/04; H04R 17/02; H04R 21/02; H04R 9/048; H04R 9/00; H04R 29/003; H04R 2209/00; H04R 2209/41

USPC ..... 381/152, 170–171, 176, 399, 408

See application file for complete search history.

(56) References Cited

U.S. PATENT DOCUMENTS

| | | | | |
|---|---|---|---|---|
| 3,164,686 A * | 1/1965 | Tibbetts | H04R 9/047 381/399 |
| 4,703,510 A * | 10/1987 | Larson | H04R 7/04 381/408 |
| 5,003,609 A * | 3/1991 | Muraoka | H04R 9/047 381/408 |
| 7,627,134 B2 * | 12/2009 | Garner | H04R 1/00 381/399 |
| 2009/0245544 A1 * | 10/2009 | Horng | H04R 9/048 381/176 |

* cited by examiner

*Primary Examiner* — Suhan Ni

(74) *Attorney, Agent, or Firm* — Na Xu; IPro, PLLC

(57) ABSTRACT

A speaker is provided in the present disclosure. The speaker includes a shell, a magnetic system received in the shell for providing a magnetic gap, and a vibrating system. The vibrating system includes a membrane, a voice coil arranged in the magnetic gap for driving the membrane to vibrate, and a coil support for supporting the voice coil. The coil support includes a first connecting member and a second connecting member parallel to each other and connected to the membrane, the voice coil is fixed between the first connecting member and the second connecting member.

18 Claims, 5 Drawing Sheets

SPEAKER

FIELD OF THE DISCLOSURE

The present disclosure relates to electro-acoustic converting technologies, and more particularly, to a speaker applicable to a mobile device for producing audible sound.

BACKGROUND

Speakers are widely applied in mobile devices, such as mobile phones, tablet computers, laptop computers, portable game players, portable multimedia devices, or the like, for converting electrical signals into audible sounds. A related speaker includes a vibration system, a magnetic system, and a holder for holding the vibration system and the magnetic system. The vibrating system includes a membrane and a coil connected to the membrane for driving the membrane to vibrate and produce sound.

Generally, when the speaker in applied in the mobile device, the coil of the speaker needs to drive the membrane to vibrate with sufficient vibration amplitude, so that the speaker can obtain have a better low frequency response; in other words, the speaker is required to have a long stroke. However, a miniaturization trend of the mobile device may restrict an inner space of the speaker and thus the vibration amplitude of the membrane is limited. Accordingly, the low frequency response of the speaker may be impacted.

Therefore, it is desired to provide a new speaker which can overcome the aforesaid problems.

BRIEF DESCRIPTION OF THE DRAWINGS

Many aspects of the embodiment can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The present disclosure will be described in detail below with reference to the attached drawings and the embodiment thereof.

Figure 1:
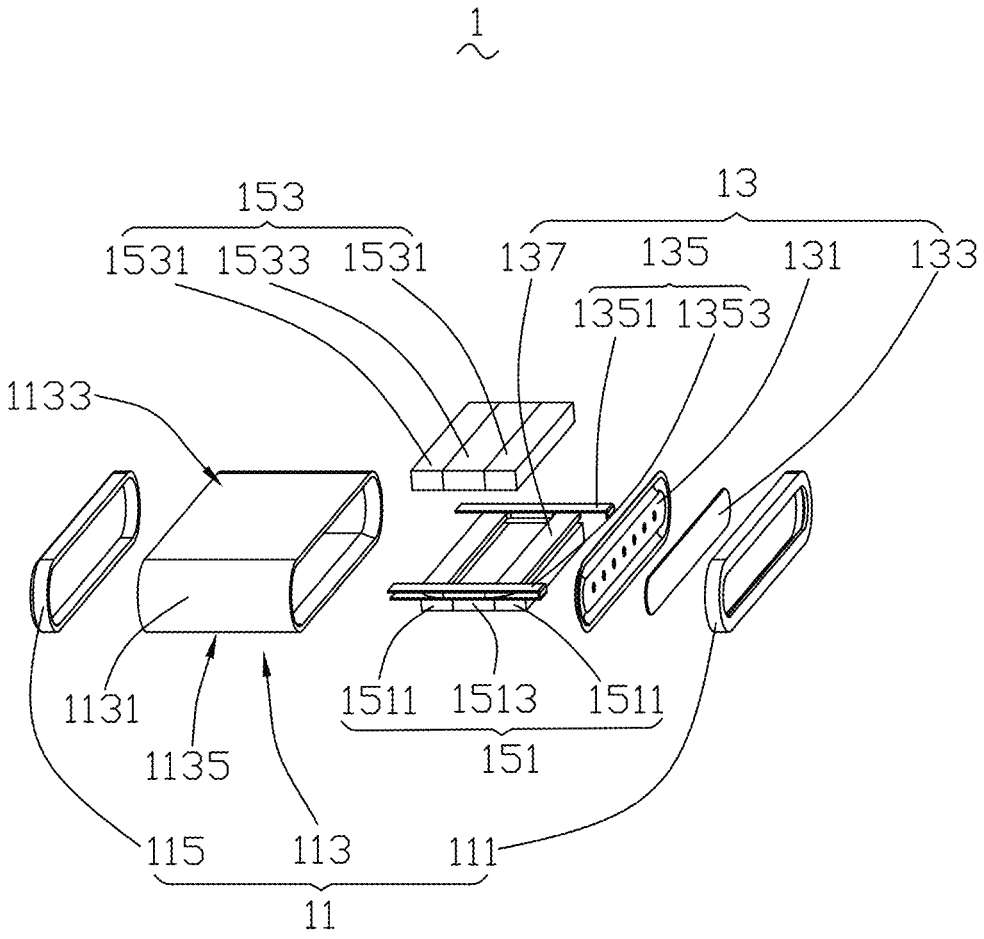
FIG. 1 is an exploded view of a speaker according to an embodiment of the present disclosure.
Figure 2:
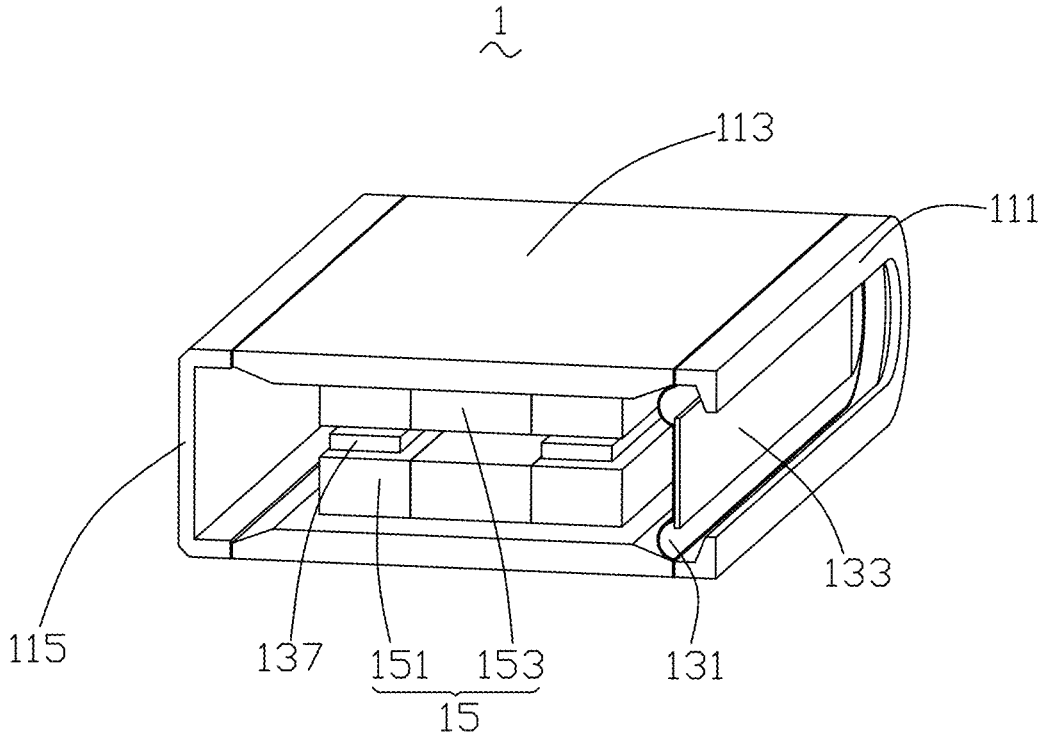
FIG. 2 is an assembled view of the speaker of FIG. 1.
Figure 3:
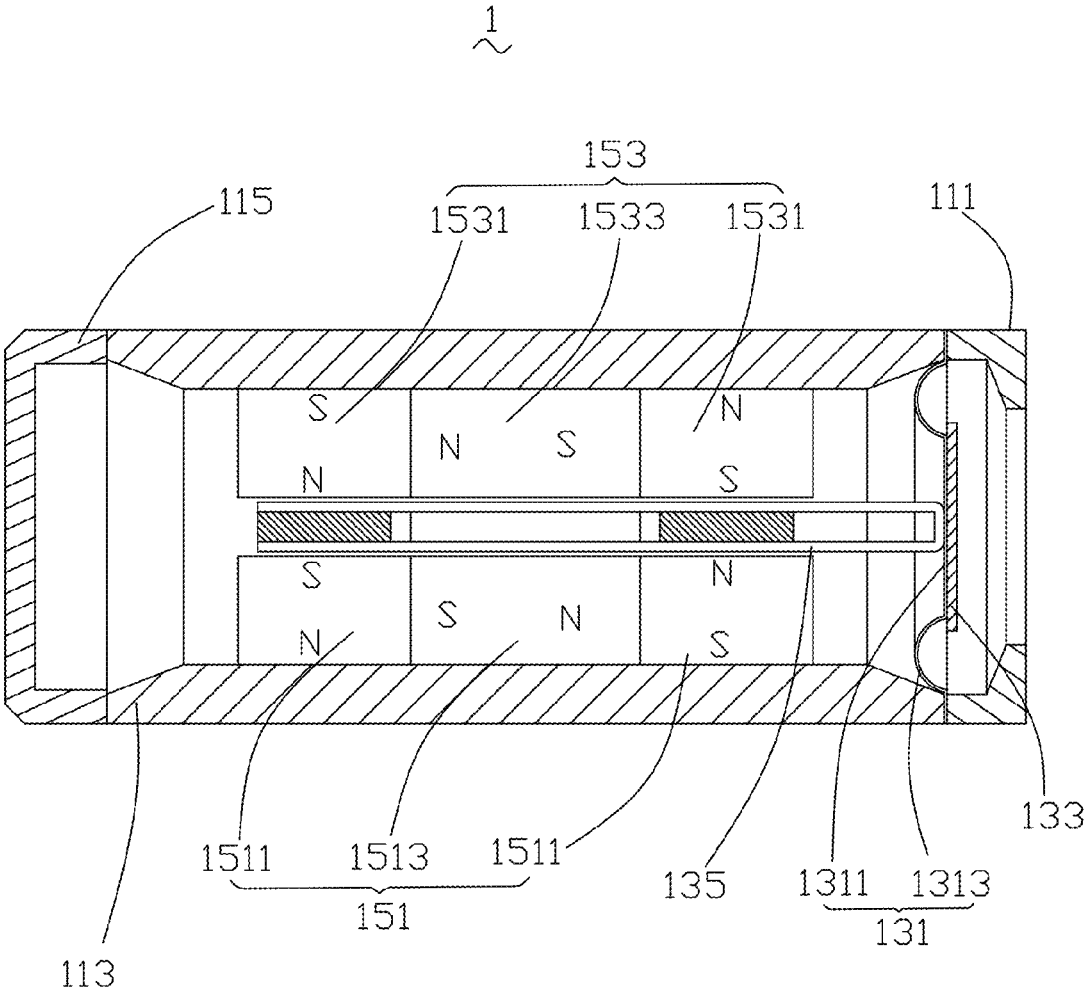
FIG. 3 is a cross-sectional view of the speaker of FIG. 1.

Referring to FIGS. 1-3, a speaker 1 according to an embodiment of the present disclosure is shown. The speaker 1 may be a long stroke speaker applicable to a mobile device, and includes a shell 11, a vibrating system 13 and a magnetic system 15. The vibrating system 13 and the magnetic system 15 are accommodated in the shell 11.

The shell 11 includes a front cover 111, a rear cover 115 and a shell body 113. The shell body 113 provides a receiving cavity for receiving the vibrating system 13 and the magnetic system 11, and may be a hollow frame with two opposite openings. In the present embodiment, the two openings are aligned along a vibration direction of the vibrating system 13, and are defined as a front opening located at a front end of the shell body 113, and a rear opening located at a rear end of the shell body 113. The shell body 113 may have a one-piece structure formed by regular non-magnetic material or soft magnetic material, the one-piece structure can ensure the shell 11 to have a good appearance, and the soft magnetic material can improve a magnetic field efficiency of the magnetic system 153 in the shell 11.

Alternatively, the shell body 113 may have a detachable configuration, for example, the shell body 113 may includes a top cover plate 1133 and a bottom cover plate 1135 arranged opposite to each other and perpendicular to the vibration direction of the vibrating system 13. The top cover plate 1133 and the bottom cover plate 1135 are detachable from a main body of the bottom shell 113, which is convenient for assembly and disassembly of speaker components (including the vibrating system 13 and the magnetic system 15) inside the shell 11.

The front cover 111 opens towards the front end of the shell body 113, and the rear cover 115 opens towards the rear end of the shell body 113; the front cover 111 and the rear cover 113 may be engaged with the front end and the rear end of the shell body 113 respectively. In particular, the front cover 111 may include an opening located opposite to the front opening of the shell body 113, the opening is defined as a sound outlet for outputting audible sound generated by the speaker 1.

Figure 5:
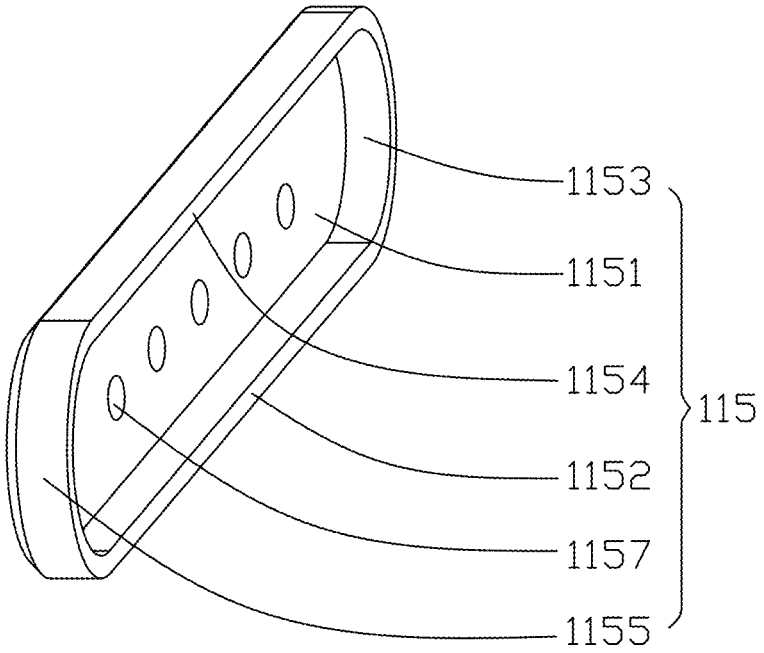
FIG. 5 is a schematic view of a rear cover of the speaker of FIG. 1.

Referring also to FIG. 5, in the present embodiment, the rear shell 115 may includes a bottom 1151 and a plurality of sidewalls 1152-1155 perpendicularly extending from the bottom 1151 towards the shell body 113. The plurality of sidewalls 1152-1155 are connected end to end, and may be defined as a first sidewall 1152, a second sidewall 1153, a third sidewall 1154 and a fourth sidewall 1155. The first sidewall 1152 and the third sidewall 1154 are both flat sidewalls and opposite to each other; the second sidewall 1153 and the fourth sidewalls 1155 are both curved sidewalls and opposite to each other, and is connected between the first sidewall 1152 and the third sidewall 1154.

Moreover, the bottom 1151 of the rear cover 115 may include a plurality of air holes 1157, the air holes 1157 are arranged in a line and are communicated with the receiving cavity of the shell body 113. The air holes 1157 are configured for providing an air excreting path for the speaker 1, and a size of the rear cover 115 is adjustable in practice so as to prevent a so-called sound short circuit phenomenon from occurring.

The vibrating system 13 includes a membrane 131, a dome 133, a coil support 135 and a voice coil 137. The membrane 131 is arranged between the front opening of the shell body 113 and the front over 111, and faces the sound outlet of the speaker 1. As such, the receiving cavity of the shell body 113 can serves as a hermetical cavity, which can not only protect the speaker components therein, but also improve sound effect of the speaker 1.

The membrane 131 includes a membrane body 1311 formed at a main central region thereof, and a periphery 1313 surrounding the membrane body 1311. In particular, the membrane body 1311 may have a rectangular configuration, and the periphery 1313 extends from an outer edge of the membrane body 1311 to form a ring-shaped configuration; and moreover, the periphery 1313 may have a curved cross section, as illustrated in FIG. 3. The periphery 1313 can enhance an intensity of the membrane 131, and ensure the membrane 131 to vibrate with great vibration amplitude.

The dome 133 is attached on a front surface of the membrane body 1311, and faces the sound outlet of the speaker 1. The dome 133 may has a size and a shape corresponding to the membrane body 1311 of the membrane 131, and is provided to further enhance the intensity of the membrane 131 and improve the sound effect of the speaker 1.

The coil 137 and the coil support 135 cooperatively form a coil assembly, which serves as a vibration driving module for driving the membrane 131 to vibrate. The coil support 135 is configured for supporting and fixing the voice coil 137, and connected to a rear surface of the membrane body 1311 adjacent to the receiving cavity of the shell body 113. As such, the membrane body 1311 of the membrane 1311 is arranged between the coil support 135 and the dome 133.

Figure 4:
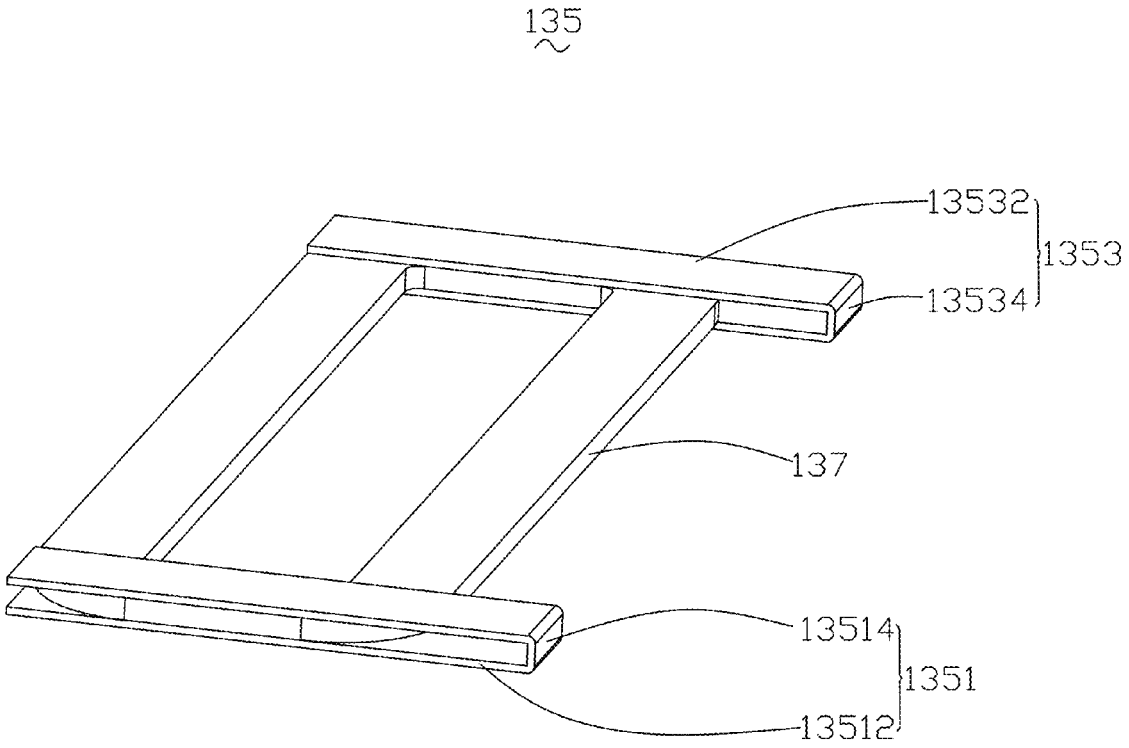
FIG. 4 is a schematic view of a coil assembly of the speaker of FIG. 1.

Referring also to FIG. 4, the coil support 135 includes a first connecting member 1351 and a second connecting member 1353 in parallel and apart from each other. The first connecting member 1351 and the second connecting member 1353 are arranged along the vibration direction of the membrane 131. The voice coil 137 can be fixed to the first connecting member 1351 and the second connecting member 1353. The coil support 135 can not only enhance an intensity of the voice coil 137 to prevent the voice coil 137 from suffer undesired deformation during operation, but also transfer motion of the voice coil 137 to the membrane 131 for driving the membrane 131 to vibrate.

Specifically, the first connecting member 1351 includes two parallel first fixing parts 13512 and a first connecting part 13514 connected between the two first fixing parts 13512. Each of the first fixing parts 13512 may be in an elongated strip shape, and includes a first connecting end adjacent to the membrane 131. The first connecting part 13514 is connected between the first connecting ends of the two first fixing parts 13512 to form a U-shaped structure with a first fixing gap, and may further abuts against the membrane body 1311 of the membrane 131.

The second connecting member 1353 may have a same configuration as the first second connecting member 1351. In detail, the second connecting member 1353 includes two parallel second fixing parts 13532 and a second connecting part 13534 connected between the two second fixing parts 13532. Each of the second fixing parts 13532 may be in an elongated strip shape, and includes a second connecting end adjacent to the membrane 131. The second connecting part 13534 is connected between the second connecting ends of the two second fixing parts 13532 to form another U-shaped structure with a second fixing gap, and may further abuts against the membrane body 1311 of the membrane 131.

The voice coil 137 may be an oblate ring-shaped coil formed by a plurality of conductive wires. The voice coil 137 may be arranged in a magnetic gap provided by the magnetic system 15 and in a plane parallel to the vibration direction of the membrane 131, and cooperate with the magnetic system 15 to obtain a long stroke. In the present embodiment, the voice coil 137 may be fixed in the first connecting gap of the first connecting member 1351 and the second connecting gap of the second connecting member 1353. For example, an end of the voice coil 137 may be sandwiched and fixed between the two first fixing parts 13512 of the first connecting member 1351, and an opposite end of the voice coil 137 may be sandwiched and fixed between the two second fixing part 13532 of the second connecting member 13.

The magnetic system 15 includes a first magnet module 151 and a second magnet module 152 opposite to and apart from each other to form the magnetic gap.

The first magnet module 151 includes two first main magnets 1511 parallel to each other and a first secondary magnet 1513 arranged between the two first main magnets 1511. The two first main magnets 1511 and the first secondary magnet 1513 are all elongated permanent magnets abutting against each other to form a one-piece structure. The two first main magnets 1511 have opposite magnetized directions, and a magnetized direction of the first secondary magnet 1513 is perpendicular to that of the first main magnets 1511.

The second magnet module 153 may have a configuration similar to the first magnet module 151, and includes two second main magnets 1531 parallel to each other and a second secondary magnet 1533 arranged between the two second main magnets 1531. The two second main magnets 1531 and the second secondary magnet 1533 are all elongated permanent magnets abutting against each other to form a one-piece structure. The two second main magnets 1531 have opposite magnetized directions, and a magnetized direction of the second secondary magnet 1533 is perpendicular to that of the second main magnets 1531.

Furthermore, the two first main magnets 1511 and the two second main magnets 1531 are opposite to each other to form the magnetic gap therebetween for receiving the voice coil 137. Each of the two first main magnets 1511 has a magnetized direction same as that of a corresponding one of the second main magnets 1531. The first secondary magnet 1513 is arranged opposite to the second secondary magnet 1533, but a magnetized direction of the first secondary magnet 1513 is opposite to that of the second secondary magnet 1533. The first secondary magnet 1513 and the second secondary magnet 1533 may have a width not less than an internal diameter of the voice coil.

For example, as illustrated in FIG. 3, an S-pole end of a first main magnet 1511 and an N-pole end of a corresponding second main magnet 1531 are arranged adjacent to the magnetic gap and face the coil assembly 135, while an N-pole end of the first main magnet 1511 and an S-pole end of the second main magnet 1531 are arranged away from the magnetic gap. Similarly, an N-pole end of the other first main magnet 1511 and an S-pole end of the other second main magnet 1531 are arranged adjacent to the magnetic gap and face the coil assembly 135, while an S-pole end of the first main magnet 1511 and an N-pole end of the second main magnet 1531 are arranged away from the magnetic gap. Furthermore, an N-pole end of the first secondary magnet 1513 is closer to the membrane 131 in relative to an S-pole end of the first secondary magnet 1513, while an S-pole end of the second secondary magnet 1533 is closer to the membrane 131 in relative to an N-pole end of the second secondary magnet 1533.

As can be seen, in the present embodiment, the magnetic system 15 is merely arranged at two opposite side of the vibration driving module, and no magnetic component is included in the vibration driving module. It should be noted that the above description is merely one of the optional configurations of the magnetic system 13, in other embodiments, for example, the first magnet module 151 may merely include a main magnet, and the second magnet module 153 may be removed or replaced by a magnetic-conductive component, alternatively, each of the first magnet module 151 and the second magnet module 153 may be consisted of a single main magnet.

In summary, the speaker 1 as provided in the present disclosure uses the coil support 135 with two opposite connecting members 1351 and 1353 to fix the voice coil 137 and transfer the motion of the voice coil 137 to the membrane 135; and with this configuration, the voice coil 137 of the speaker 1 can be ensured to have a long stroke as required. Therefore, the speaker 1 can obtain good low frequency response, but also meet the miniaturization requirement of a mobile device.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A speaker, comprising:

a shell;

a magnetic system received in the shell for providing a magnetic gap;

a vibrating system comprising a membrane, a voice coil arranged in the magnetic gap for driving the membrane to vibrate, a coil support for supporting the voice coil, and a dome attached on the membrane body of the membrane; the dome and the coil support are respectively arranged at two opposite sides of the membrane body;

wherein the coil support comprises a first connecting member and a second connecting member parallel to each other and connected to the membrane, the voice coil is fixed between the first connecting member and the second connecting member.

2. The speaker of claim 1, wherein the first connecting member and the second connecting member provide a first fixing gap and a second fixing gap respectively, and two opposite ends of the voice coil are respectively fixed in the first fixing gap and the second fixing gap.

3. The speaker of claim 1, wherein each of the first connecting member and the second connecting member comprises two parallel fixing parts and a connecting part connected between the fixing parts, and the connecting part is connected to the membrane.

4. The speaker of claim 3, wherein each of the two fixing parts is in an elongated strip shape and comprises a connecting end, and the connecting part is connected between the connecting ends of the two fixing parts to form a U-shaped structure.

5. The speaker of claim 4, wherein an end of the voice coil is sandwiched between the two fixing parts of the first connecting member, and an opposite end of the voice coil is sandwiched between the two fixing part of the second connecting member.

6. The speaker of claim 5, wherein the voice coil is an oblate ring-shaped coil.

7. The speaker of claim 3, wherein the membrane comprises a membrane body and a periphery surrounding the membrane body.

8. The speaker of claim 7, wherein the connecting part of the coil support is connected to the membrane body of the membrane.

9. The speaker of claim 1, wherein the magnetic system comprises a first magnet module and a second magnet module opposite to and apart from each other to form the magnetic gap.

10. The speaker of claim 9, wherein each of the first magnet module and the second magnet module comprises two main magnets parallel to each other and a secondary magnet arranged between the two main magnets.

11. The speaker of claim 10, wherein the two main magnets have opposite magnetized direction, and a magnetized direction of the secondary magnet is perpendicular to that of the two main magnets.

12. The speaker of claim 11, wherein the two main magnets and the secondary magnet of the first magnet module are respectively opposite to the two main magnets and the secondary magnet of the second magnet module.

13. The speaker of claim 12, wherein each of the two main magnets of the first magnet module has a magnetized direction same as a corresponding one of the two main magnets of the second magnet module.

14. The speaker of claim 13, wherein the secondary magnet of the first magnet module has a magnetized direction opposite to the secondary magnet the second magnet module.

15. The speaker of claim 1, wherein the shell comprises a front cover, a shell body and a rear cover, the shell body provides a receiving cavity for receiving the magnetic system and the vibrating system, and comprises a front opening and a rear opening; the front cover and the rear cover are engaged with a front end and a rear end of the shell body for covering the front opening and the rear opening.

16. The speaker of claim 15, wherein the shell body is made of non-magnetic material or soft magnetic material.

17. The speaker of claim 15, wherein the shell body comprises a top cover plate and a bottom cover plate opposite to each other, the top cover plate and the bottom cover plate are detachable from a main body of the shell body.

18. The speaker of claim 15, wherein the rear cover comprises a bottom and a plurality of sidewalls perpendicularly extending from the bottom, the bottom comprises a plurality of air holes communicated with the receiving cavity of the shell body.

* * * * *